US009042798B2

(12) United States Patent
Kishimoto

(10) Patent No.: US 9,042,798 B2
(45) Date of Patent: May 26, 2015

(54) FIXING DEVICE AND IMAGE FORMING APPARATUS

(75) Inventor: Teruki Kishimoto, Kanagawa (JP)

(73) Assignee: FUJI XEROX CO., LTD., Ashigarakami-Gun, Kanagawa (JP)

( * ) Notice: Subject to any disclaimer, the term of this patent is extended or adjusted under 35 U.S.C. 154(b) by 262 days.

(21) Appl. No.: 13/556,482

(22) Filed: Jul. 24, 2012

(65) Prior Publication Data

US 2013/0202332 A1 Aug. 8, 2013

(30) Foreign Application Priority Data

Feb. 2, 2012 (JP) ..... 2012-020851

(51) Int. Cl.
*G03G 15/20* (2006.01)

(52) U.S. Cl.
CPC .. *G03G 15/2007* (2013.01); *G03G 2215/00223* (2013.01)

(58) Field of Classification Search
CPC ..... G03G 15/2007; G03G 15/201
USPC ..... 399/227, 336
See application file for complete search history.

(56) References Cited

FOREIGN PATENT DOCUMENTS

| | | |
|---|---|---|
| JP | A-60-107069 | 6/1985 |
| JP | U-61-89866 | 6/1986 |
| JP | A-2005-241704 | 9/2005 |
| JP | 2011221469 A * | 11/2011 |

OTHER PUBLICATIONS

Tasaka (JP 2011-221469 A) Nov. 2011, JPO Computer Translation.*

* cited by examiner

*Primary Examiner* — Erika J Villaluna
(74) *Attorney, Agent, or Firm* — Oliff PLC

(57) ABSTRACT

A fixing device includes a radiating portion that radiates light on a recording medium on which a toner image is formed and that is transported along a transport path, a partition member that transmits the light radiated from the radiating portion and partitions between the radiating portion and the transport path, and a drive section that moves a scraping member scraping toner that adheres to the partition member and is heated by the radiation of the light from the radiating portion so as to contact a surface of the partition member of the transport path side.

13 Claims, 8 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-020851 filed Feb. 2, 2012.

BACKGROUND (i) Technical Field

The present invention relates to a fixing device and an image forming apparatus.

(ii) Related Art

For example, a technology is known in which light radiation is used in a fixing processing of an electrographic process. In general, a radiating portion that radiates light is partitioned with a transport path of paper by a partition member such as a cover glass. When toner adheres to the partition member, the adhesion toner blocks the light that is radiated from the radiating portion. In this case, efficiency in which the toner is fixed to the paper is decreased.

SUMMARY

According to an aspect of the present invention, there is provided a fixing device including: a radiating portion that radiates light on a recording medium on which a toner image is formed and that is transported along a transport path; a partition member that transmits the light radiated from the radiating portion and partitions between the radiating portion and the transport path; and a drive section that moves a scraping member scraping toner that adheres to the partition member and is heated by the radiation of the light from the radiating portion so as to contact a surface of the partition member of the transport path side.

BRIEF DESCRIPTION OF THE DRAWINGS

Exemplary embodiments of the present invention will be described in detail based on the following figures, wherein.

DETAILED DESCRIPTION

Figure 1:
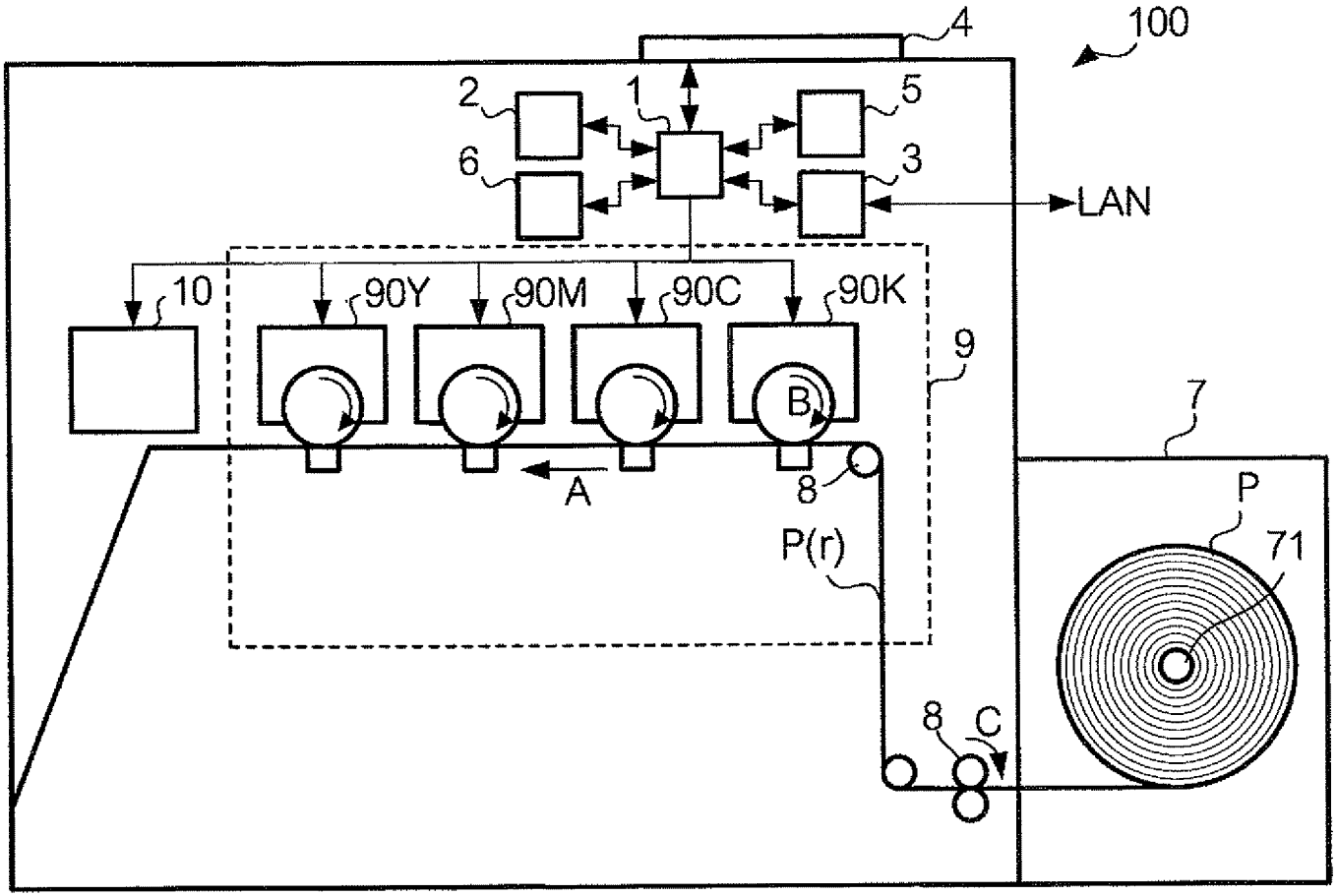
FIG. 1 is a schematic view showing a hardware configuration of an image forming apparatus.

FIG. 1 is a schematic view showing a hardware configuration of an image forming apparatus 100. The image forming apparatus 100 includes a controller 1, a memory 2, a communication portion 3, a receiving portion 4, an imaging reading portion 5, an image processing portion 6, a storing portion 7, a transport roll 8, an image forming portion 9, and a fixing device 10 in an inner portion of a housing. The controller 1 controls an operation of each portion of the image forming apparatus 100. The controller 1 includes a CPU (Central Processing Unit), a ROM (Read Only Memory), and a RAM (Random Access Memory). The memory 2 includes a device which stores data and programs used by the controller 1, for example, an HDD (Hard Disk Drive). The communication portion 3 is connected to an external device such as a personal computer or a facsimile machine, and sends and receives image data. The receiving portion 4 receives the input of an instruction from a user. The receiving portion 4 includes various operational units by which the user inputs the instruction to the image forming apparatus 100. The instruction received through the receiving portion 4 is sent to the controller 1, and the controller 1 controls the operation of the image forming apparatus 100 in accordance with the instruction. The image reading portion 5 optically reads a document and generates image signals. Specifically, the image reading portion 5 includes a platen glass, a light source, an optical system, and an imaging device (all not shown). The light source radiates light with respect to the document placed on the platen glass, the light reflected by the document is split into R (red), G (green), and B (blue) via the optical system, and the split light enters the imaging device. The imaging device converts the incident light into image signals, and the image signals are supplied to the image processing portion 6. The image processing portion 6 performs an A/D conversion on the image signals that are supplied from the image reading portion 5, a noise reduction, a gamma correction, a conversion from R (red), G (green), B (blue) to Y (yellow), M (magenta), C (cyan), and K (black), a screen processing, and the like. In this way, the image data representing gradations of every color and every pixel are generated.

The storing portion 7 stores a sheet-like recording medium P. The recording medium P is a continuous paper (referred to as "continuous form" or "continuous form paper") that is not cut into single pages, and is stored in a state of being wound around a shaft 71. In addition, when the recording medium P is divided at perforations for each page, the storing portion 7 may be configured so that the recording medium is stored in a state of being folded in a zigzag manner along the perforated surfaces. The transport roll 8 (an example of a transport portion) transports the recording medium P along a transport path r. In addition to the shown one, plural transport rolls 8 are provided on the transport path r. The image forming portion 9 (an example of a formation portion) includes image forming processing units 90Y, 90M, 90C, and 90K. The image forming processing units 90Y, 90M, 90C, and 90K repeatedly form the toner image of each of yellow, magenta, cyan, and black to the surface of the recording medium P according to an electrographic method based on the image data supplied from the image processing portion 6. Since the configuration of each of the image forming processing units is common, hereinafter, when it is not necessary to distinguish each of the image forming processing units, the image forming processing units are collectively referred to as the image forming processing unit 90. In addition, also with respect to the components of the image forming processing unit 90, notations such as Y, M, C, and K are omitted. The fixing device 10 fixes the toner image transferred by the image forming portion 9 to the recording medium P. The recording medium P on which the toner image is fixed is discharged to the outside of the image forming apparatus 100. For example, the discharged recording medium P is cut a page at a time by a cutting device (not shown). Hereinafter, the direction (direction of an arrow A) in which the paper p is transported is simply referred to as the "transporting direction", and a direction (direction perpendicular to a paper surface of FIG. 1) perpendicular to the transporting direction is referred to as the "width direction".

Figure 2:
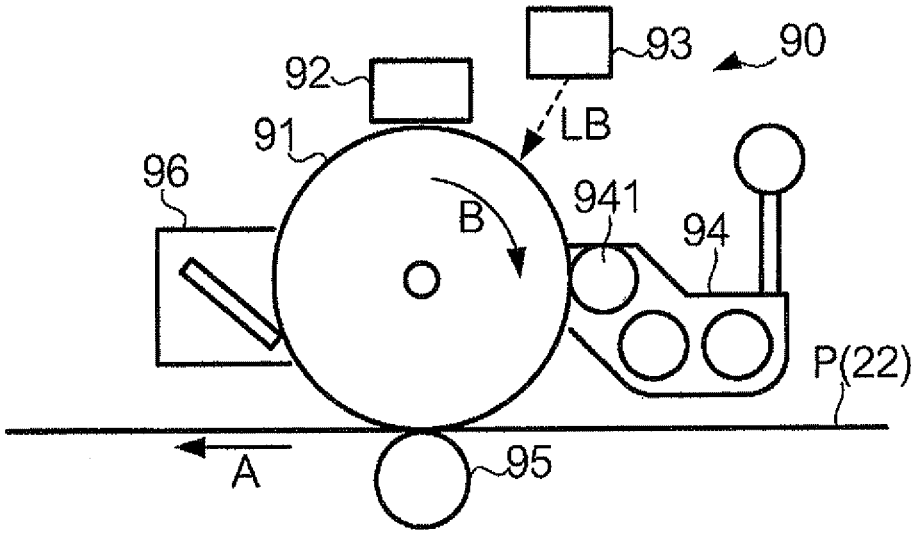
FIG. 2 is a schematic view of an image forming processing unit when viewed from one side in a width direction.

FIG. 2 is a schematic view of the image forming processing unit 90 when viewed from one side in the width direction. The image forming processing unit 90 includes a photoconductor drum 91, a charging device 92, an exposure device 93, a developing device 94, a transfer device 95, and a cleaner 96. The photoconductor drum 91 is a cylindrical member in which a photoconductive film is laminated around the outer circumferential surface thereof, and is supported so as to rotate in the direction of an arrow B with the center of the cylinder as an axis. For example, the charging device 92 may be a scorotron charger and charges the photoconductive film of the photoconductor drum 91 to a potential which is predetermined. The exposure device 93 exposes the photoconductor drum 91 charged by the charging device 92 and forms an electrostatic latent image. Specifically, laser light LB corresponding to the gradation of each pixel representing by the image data which are supplied from the image processing portion 6 is generated, and the laser light LB scans the photoconductive film of the photoconductor drum 91 in the width direction. The photoconductor drum 91 rotates in the direction of the arrow B, and writing of the electrostatic latent image at a scan line unit in the width direction is repeated in the transporting direction.

The developing device 94 develops the electrostatic latent image formed on the photoconductor drum 91. The developing device 94 includes a development roller 941 which is provided so as to be opposite to the outer circumferential surface of the photoconductor drum 91. A two-component developer including the toner and a carrier is accommodated in the inner portion of the developing device 94. The toner is one in which powder made of resin is colored with any one color material of yellow, magenta, cyan, and black. The carrier is a powder that is manufactured from a magnetic material. The two-component developer is attached to the outer circumferential surface of the development roller 941, which is driven to rotate, through a magnetic force. A developing bias having a reverse polarity to the electrostatic latent image is applied to the development roller 941. If the toner is charged so as to have a reverse polarity to the electrostatic latent image by the developing bias, the toner moves on the electrostatic latent image and the toner image is formed. The transfer device 95 is a cylindrical member that is opposite to the photoconductor drum 91 while interposing the transport path r. A transfer bias having a reverse polarity to the toner image is applied to the transfer device 95. If the recording medium P is charged so as to have a reverse polarity to the toner image by the transfer bias, the toner image is transferred to the recording medium P. If the recording medium P passes through the image forming processing units 90K, 90C, 90M, and 90Y, the toner image is repeatedly transferred. The cleaner 96 removes the toner remaining on the surface of the photoconductor drum 91 after the toner image is transferred.

Figure 3:
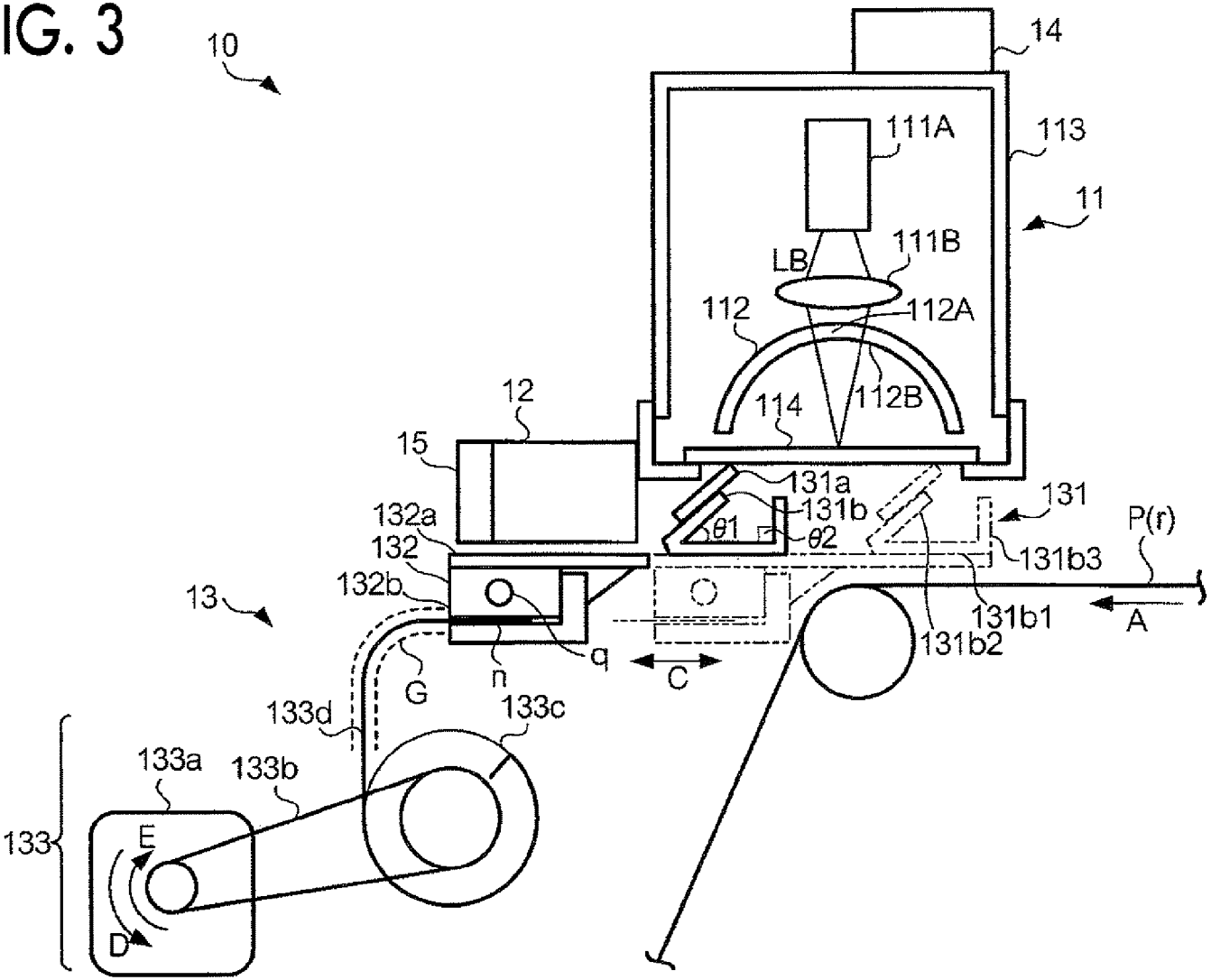
FIG. 3 is a view of a fixing device when viewed from the one side in the width direction.
Figure 4:
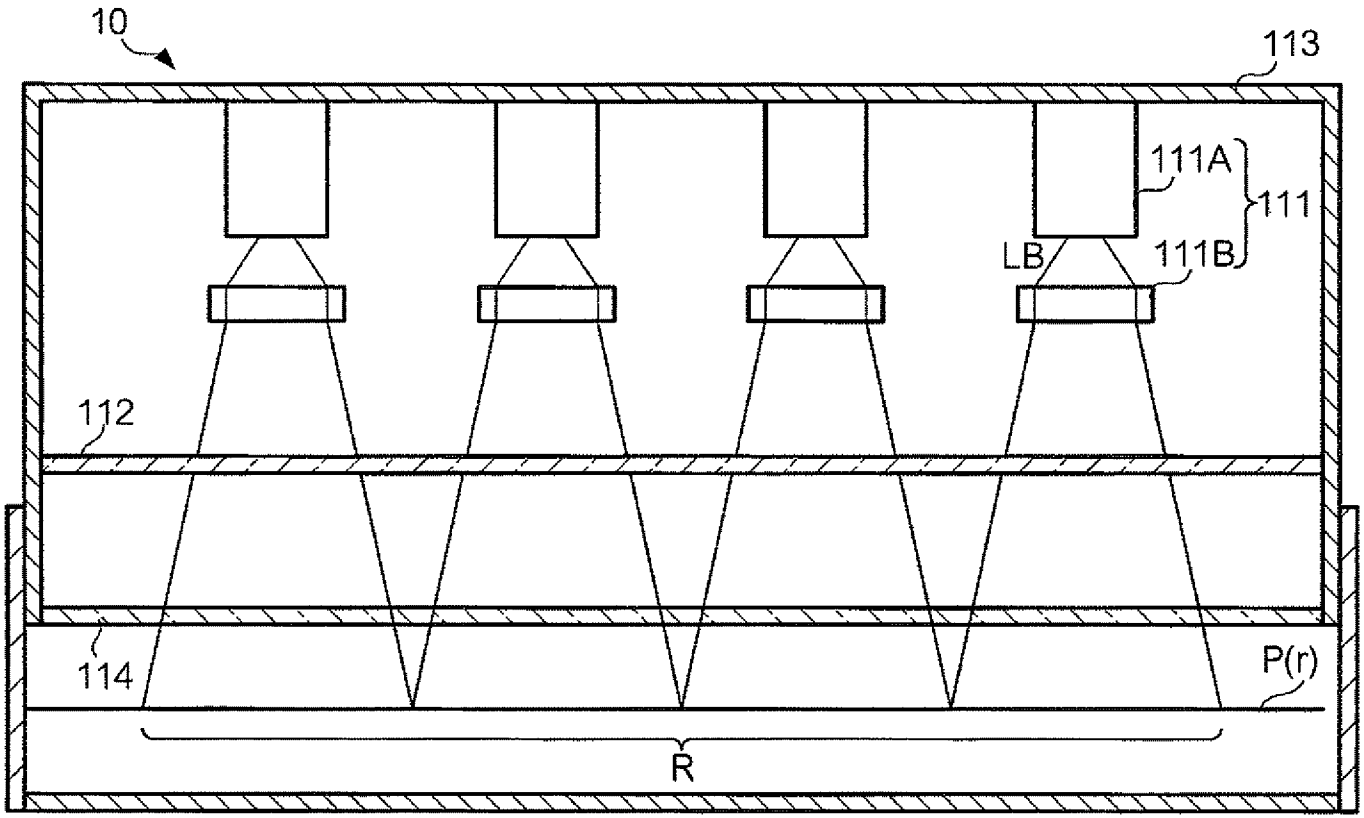
FIG. 4 is a cross-sectional view of a fixing device when viewed from an upstream side in a transporting direction.

FIG. 3 is a view of the fixing device 10 when viewed from the one side in the width direction. FIG. 4 is a cross-sectional view of the fixing device 10 when viewed from an upstream side in a transporting direction. As shown in FIG. 3, the fixing device 10 includes a fixing portion 11, a dust collecting portion 12, a cleaning portion 13, a cooling fan 14, and a temperature detection portion 15.

The fixing portion 11 includes a radiating portion 111, a light condensing member 112, a supporting member 113, and a partition member 114. The radiating portion 111 includes a light source 111A and lens 111B. The light source 111A is a device that generates laser light LB. The wavelength of the laser light LB may be any wavelength as long as heat sufficient to melt the toner is applied to the toner, and is preferably infrared rays. In this case, toner to which a material absorbing the infrared rays is mixed is used in the developing device 94. The laser light LB emitted from the light source 111A propagates while being diffused until reaching the lens 111B. The lens 111B controls a direction of the propagation of the laser light LB that is emitted from the light source 111A. In the lens 111B, a cross-section having the width direction as a vertical direction is formed in a convex shape. The lens 111B converges the laser light LB on the transport path r so that the irradiation width in the transporting direction is within a determined range (for example, 1.0±0.1 mm). In addition, as shown in FIG. 4, a cross-section of the lens 111B having the transporting direction as a vertical direction is a rectangle. Thereby, the lens 111B propagates the laser light LB while diffusing it in the width direction. Plural radiating portions 111 are provided so as to be lined up in the width direction so that the laser light LB radiates on the entire region in which the toner image of the recording medium P may be formed. In FIG. 4, four radiating portions 111 are lined up in the width direction. As a result, the laser light LB radiates a radiation area R that extends in the width direction. As shown in FIG. 3, a portion of the transport path r to the upstream side of the radiation area R, and a portion of the transport path r to the downstream side of the radiation area R extend in different directions to each other.

The light condensing member 112 reflects the laser light LB that is reflected at the surface of the recording medium P, and focuses the laser light LB on the surface of the recording medium P. The light condensing member 112 includes a hole 112A and a reflective surface 112B. The hole 112A allows the laser light LB radiated from the radiating portion 111 to pass through. The reflective surface 112B is formed in a concave shape and is opposite to the transport path r. Specifically, the reflective surface 112B is formed so as to have an arch shape in a cross-section having the width direction as a vertical direction. The reflective surface 112B is subject to processing for reflecting the laser light LB. For example, the light condensing member 112 is manufactured of metal such as aluminum, the reflective surface 112B may be polished, and the reflective surface 112B may be subjected to plating such as silver.

The laser light LB passing through the hole 112A of the light condensing member 112 reaches the recording medium P. However, the laser light LB is reflected on the surface of the recording medium P at a region on which the toner particles do not adhere. Since not only a mirror reflection but also a diffusion reflection are generated on the surface of the recording medium P, reflection in all directions may be generated. The laser light LB reflected at the surface of the recording medium P is reflected at the reflective surface 112B, and therefore, a portion of the reflected light enters the toner particles and the remainder is reflected at the surface of the recording medium P again. In this way, if the reflection of the laser light LB is repeated at the surface of the recording medium P and the reflective surface 112B of the light condensing member 112, a portion of the laser light LB reflected at the reflective surface 112B is absorbed by the toner and promotes the heating and melting of the toner.

The supporting member 113 is a housing that has an opening at the transport path r side, and supports the radiating portion 111, the light condensing member 112, and the partition member 114. A portion of the toner heated by the laser light LB is sublimated and becomes a gas, and the gas is cooled and dust may be generated. The partition member 114 partitions between the radiating portion 111 and the transport path r so that the dust does not enter a space that is enclosed by the supporting member 113. As a result, the radiating portion 111 is covered by the supporting member 113 and the partition member 114. The partition member 114 is a rectangular and plate-shaped member including short sides and long sides and is formed of a material transmitting light, for example, quartz glass. In the partition member 114, the short sides are provided so as to be along the transporting direction and the long sides are provided so as to be along the width direction. For example, the length of the short sides of the partition member 114 is 50.0 mm.

The dust collecting portion 12 removes the dust that is generated at the fixing device 10. The dust collecting portion 12 includes an inlet port and an outlet port. The dust collecting portion 12 suctions the dust along with air from the inlet port and discharges filtered air from the outlet port. For example, the inlet port of the dust collecting portion 12 is provided so as to have a length greater than the length of the radiation area R in the width direction.

A portion of the dust that is not removed by the dust collecting portion 12 may adhere to the partition member 114. In addition, when processing is abnormally stopped due to an error or the like of the printing system and a user removes the recording medium P, unfixed toner may adhere to the partition member 114. The cleaning portion 13 performs an adhesion toner removal processing that removes the dust or toner (hereinafter, referred to as "adhesion toner") adhering to the partition member 114. The cleaning portion 13 includes a cleaning unit 131, a slide mechanism portion 132, and a drive portion 133. The cleaning unit 131 includes a scraping member 131*a* and a holding member 131*b*. The scraping member 131*a* extends in the width direction along the partition member 114 and is a plate-shaped member that contacts the surface of the partition member 114 of the transport path r side. The scraping member 131*a* has a length required to remove the adhesion toner in the width direction. For example, the thickness of the scraping member 131*a* is 0.3 mm. For example, the scraping member 131*a* is formed of stainless steel. The holding member 131*b* is a member that holds the scraping member 131*a*. The holding member 131*b* is a member including two places that are bent in the cross-section having the width direction as a vertical direction. The holding member 131*b* includes a bottom plate 131*b*1, a side plate 131*b*2, and a side plate 131*b*3 that extend in the width direction. For example, an angle θ1 between the bottom plate 131*b*1 and the side plate 131*b*2 is 60°. For example, an angle θ2 between the bottom plate 131*b*1 and the side plate 131*b*3 is 90°. A portion of the scraping member 131*a* is anchored to the side plate 131*b*2 in the width direction.

The slide mechanism portion 132 moves the cleaning unit 131 so that the scraping member 131*a* contacts the surface of the partition member 114 and moves in the transporting direction. The slide mechanism portion 132 includes a plate-shaped member 132*a* that places the cleaning unit 131 and a box-shaped member 132*b* that extends along the width direction. A protrusion q is provided at each of the surfaces of both ends of the box-shaped member 132*b* in the width direction. The protrusion q is inserted in a groove (not shown) that is provided in the housing of the image forming apparatus 100. The protrusion q moves along the groove provided in the housing, and therefore, the slide mechanism portion 132 moves in the direction of an arrow C. Moreover, the slide mechanism portion 132 includes a holding area n.

The drive portion 133 supplies a drive force for moving the slide mechanism portion 132. The drive portion 133 includes a drive motor 133*a*, a belt member 133*b*, a cylindrical drive roller 133*c*, and a plate spring 133*d*. One side end of the plate spring 133*d* is held by the holding area n, and the other side end of the plate spring 133*d* is fixed to the drive roller 133*c*. The drive motor 133*a* rotates in the direction of an arrow D or a direction of an arrow E, and is a stepping motor. If the drive motor 133*a* transmits the drive force of the direction of the arrow D to the drive roller 133*c* via the belt member 133*b*, an area in which the cylinder surface of the drive roller 133*c* contacts the surface of the plate spring 133*d* is increased, and the drive roller 133*c* rolls up the plate spring 133*d*. If the drive motor 133*a* transmits the drive force of the direction of the arrow E to the drive roller 133*c* via the belt member 133*b*, the area in which the cylinder surface of the drive roller 133*c* contacts the surface of the plate spring 133*d* is decreased, and the drive roller 133*c* extrudes the plate spring 133*d*. A guide area G that limits the trajectory of the plate spring 133*d* is provided in the housing of the image forming apparatus 100. The plate spring 133*d* is rolled up to the drive roller 133*c* or is extruded from the drive roller 133*c* while being guided along the guide area G. If the plate spring 133*d* is rolled up, the slide mechanism portion 132 is away from the transport path r, and if the plate spring 133*d* is extruded, the slide mechanism portion 132 approaches the transport path r. The drive motor 133*a* repeatedly transmits the drive force in the direction of the arrow D and in the direction of the arrow E, and therefore, the slide mechanism portion 132 repeatedly moves in the direction of the arrow C. The slide mechanism portion 132 and the drive portion 133 are an example of a drive section.

The cleaning unit 131 is inserted in the fixing device 10 by a user when the user performs the cleaning of the adhesion toner. Specifically, the cleaning unit 131 is fastened on the plate-shaped member 132*a* and is inserted in the space between the plate-shaped member 132*a* and the partition member 114.

The cooling fan 14 cools the inner portion of the fixing portion 11. The cooling fan 14 discharges the heat generated in the fixing portion 11 to the outside of the fixing portion 11. The temperature detection portion 15 detects the temperature of the partition member 114. For example, the temperature detection portion 15 alternatively detects the temperature of the partition member 114 by detecting the temperature of air exhausted from the outlet port of the dust collecting portion 12.

Figure 5:
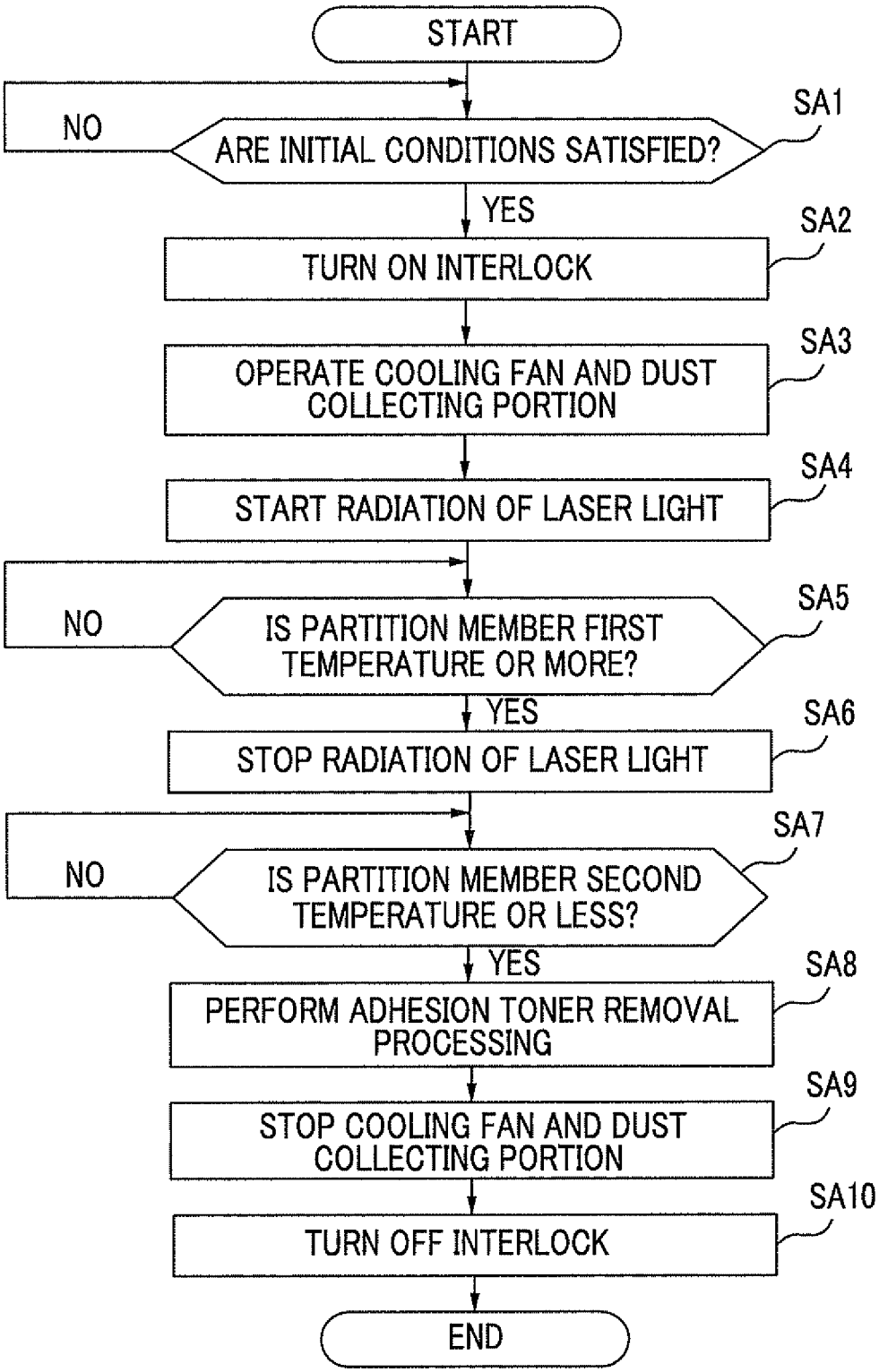
FIG. 5 is a flowchart showing an operation of the fixing device when adhesion toner is cleaned.

FIG. 5 is a flowchart showing an operation of the fixing device 10 when adhesion toner is cleaned. Before the operation shown in FIG. 5 is performed, a user operates the receiving portion 4 and inputs instructions for starting the cleaning of the adhesion toner. Next, the user inserts the cleaning unit 131 in the inner portion of the fixing device 10. The controller 1 reads a program for cleaning the adhesion toner from the memory 2. In step SA1, the controller 1 determines whether or not the image forming apparatus 100 satisfies initial conditions for performing the adhesion toner removal processing. Specifically, the controller 1 confirms that an external cover of the image forming apparatus 100 is closed, that the recording medium P is not present in the radiation area R, and that the cleaning unit 131 is inserted with a correct posture for removing the adhesion toner at the initial conditions. The controller 1 confirms whether or not the initial conditions are satisfied based on information detected from a sensor that is provided to be opposite to the external cover, a sensor that is provided to be opposite to the radiation area R, and a sensor that is provided at one side in the width direction of the fixing portion 11 (all not shown). When these initial conditions are satisfied (YES at step SA1), the controller 1 advances the processing to step SA2. When these initial conditions are not satisfied (NO at step SA1), the controller 1 stands ready for the processing until the initial conditions are satisfied.

In step SA2, the controller 1 turns on an interlock. The interlock is a mechanism that makes the external cover not to open when the operation is performed for safely carrying out the cleaning operation of the adhesion toner. Due to the fact that the interlock is turned on, the user may not open the external cover of the image forming apparatus 100 when the cleaning operation of the adhesion toner is performed. In step SA3, the controller 1 operates the dust collecting portion 12 and the cooling fan 14. In step SA4, the controller 1 starts the radiation of the laser light LB using the light source 111A. The controller 1 controls the light source 111A so that the output of the laser light LB from the light source 111A is lower than the output of the laser light when the toner is fixed to the recording medium P (hereinafter, referred to "at the time of fixing of the toner"). This is to prevent the heat generated in fixing portion 11 from not being completely cooled since the radiation time of the laser light LB when the cleaning operation of the adhesion toner is performed is longer than the radiation time of the laser light LB at the time of fixing of the toner. If the radiation of the laser light starts, the partition member 114 and the adhesion toner are heated, and temperature thereof is increased. In step SA5, the controller 1 determines whether or not the temperature of the partition member 114 is equal to or higher than a first temperature. The first temperature is a predetermined temperature, and the adhesion toner is melted when the temperature of the partition member 114 is the first temperature. For example, the first temperature is 300° C. The controller 1 obtains the temperature of the partition member 114 from the temperature detection portion 15. When the temperature of the partition member 114 is equal to or higher than the first temperature (YES at step SA5), the controller 1 advances the processing to step SA6. When the temperature of the partition member 114 is lower than the first temperature (NO at step SA5), the controller 1 continues the radiation of the laser light LB.

In the step SA6, the controller 1 stops the radiation of the laser light LB from the light source 111A. If the radiation of the laser light LB stops, the partition member 114 and the adhesion toner are heated, and temperature thereof is decreased. In step SA7, the controller 1 determines whether or not the temperature of the partition member 114 is equal to or lower than a second temperature. The second temperature is a temperature that is predetermined and is lower than the first temperature. When the temperature of the partition member 114 is the second temperature, the adhesion toner is melted. Compared to before the radiation of the laser light LB starts and when the temperature of the partition member 114 is the first temperature, when the temperature of the partition member 114 is the second temperature, the adhesion toner is more easily removed from the partition member 114. For example, the second temperature is 200° C. The controller 1 obtains the temperature of the partition member 114 from the temperature detection portion 15. When the temperature of the partition member 114 that is obtained from the temperature detection portion 15 is equal to or lower than the second temperature (YES at the step SA7), the controller 1 advances the processing to step SA8. When the temperature of the partition member 114 is higher than the second temperature (NO at the step SA7), the controller 1 stands ready for the processing until the temperature of the partition member 114 is equal to or lower than the second temperature.

In the step SA8, the controller 1 starts the adhesion toner removal processing using the cleaning portion 13. If the adhesion toner removal processing starts, the drive portion 133 drives the slide mechanism portion 132. The slide mechanism portion 132 repeatedly moves the cleaning unit 131 in the direction along the partition member 114. In the adhesion toner removal processing, the slide mechanism portion 132 reciprocates a determined number of times. For example, the number of reciprocations of the slide mechanism portion 132 is 6. If the slide mechanism portion 132 reciprocates plural number of times, the adhesion toner that is not scraped through a single reciprocating is removed.

Figure 6:
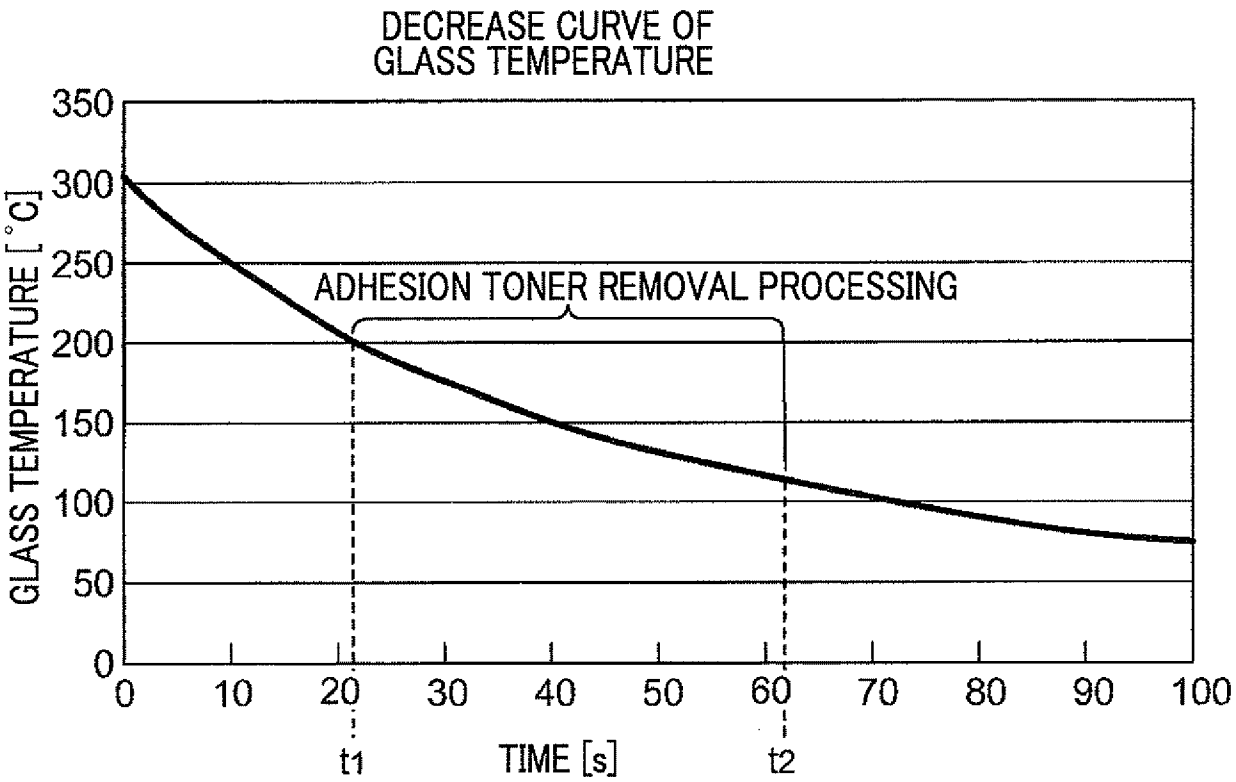
FIG. 6 is a graph showing temperature changes with the passage of time of a partition member in an adhesion toner removal processing.

FIG. 6 is a diagram showing temperature changes with the passage of time of the partition member 114 in the adhesion toner removal processing. The horizontal axis indicates a time t(s) and the vertical axis indicates the temperature T (° C.) of the partition member 114. In FIG. 6, in the above-described step SA5, the time when the temperature of the partition member 114 is 300° C. is expressed as 0 seconds. If the temperature of the partition member 114 is 300° C., since the radiation of the laser light LB stops, the temperature of the partition member 114 is decreased with the passage of time. The adhesion toner removal processing is performed when the temperature of the partition member 114 is within a certain temperature range. The controller 1 controls the cleaning portion 13 so that the adhesion toner removal processing is performed when the temperature of the partition member 114 is within a certain temperature range. For example, the certain temperature range is until the temperature of the partition member 114 is decreased from 200° C. to 120° C. (from 120° C. to 200° C.). In FIG. 6, the temperature of the partition member 114 at time t1 when 20 seconds have passed becomes 200° C., and the temperature of the partition member 114 at time t2 in which 40 seconds have passed from the time t1 becomes 120° C. Therefore, the controller 1 controls the cleaning portion 13 so that the adhesion toner removal processing is performed from the time t1 to the time t2.

In the present exemplary embodiment, for example, the length of the scraping member 131*a* that contacts the partition member 114 in the length of the partition member 114 in the transporting direction is 46.7 mm. At this time, for example, the controller 1 controls the rotation of the drive motor 133*a* so that the slide mechanism portion 132 moves at speed of 15.6 (mm/s). Thereby, the slide mechanism portion 132 moves so as to reciprocate 6 times in the direction shown in the arrow C in FIG. 3 from the time t1 to the time t2. According to the adhesion toner removal processing, the scraping member 131*a* scrapes the adhesion toner. The scraped toner is accumulated in a space formed by the bottom plate 131*b*1, the side plate 131*b*2, and the side plate 131*b*3 or is removed by the dust collecting portion 12.

Refer to FIG. 5 again. In step SA9, the controller 1 stops the dust collecting portion 12 and the cooling fan 14. In step SA10, the controller 1 turns off the interlock. The interlock is turned off, and therefore, the user may open and close the external cover of the image forming apparatus 100. The user opens the external cover and removes the cleaning unit 131 from the fixing device 10.

MODIFICATION

The present invention is not limited to the above-described exemplary embodiment, and various modifications may be performed. Hereinafter, some modifications will be described. Two or more modifications among the modifications described below may be used in combination.

First Modification

The adhesion toner removal processing is not limited to the case where the adhesion toner removal processing is performed after the radiation of the laser light LB stops. The adhesion toner removal processing may be performed when the radiation of the laser light LB is performed.

Figure 7:
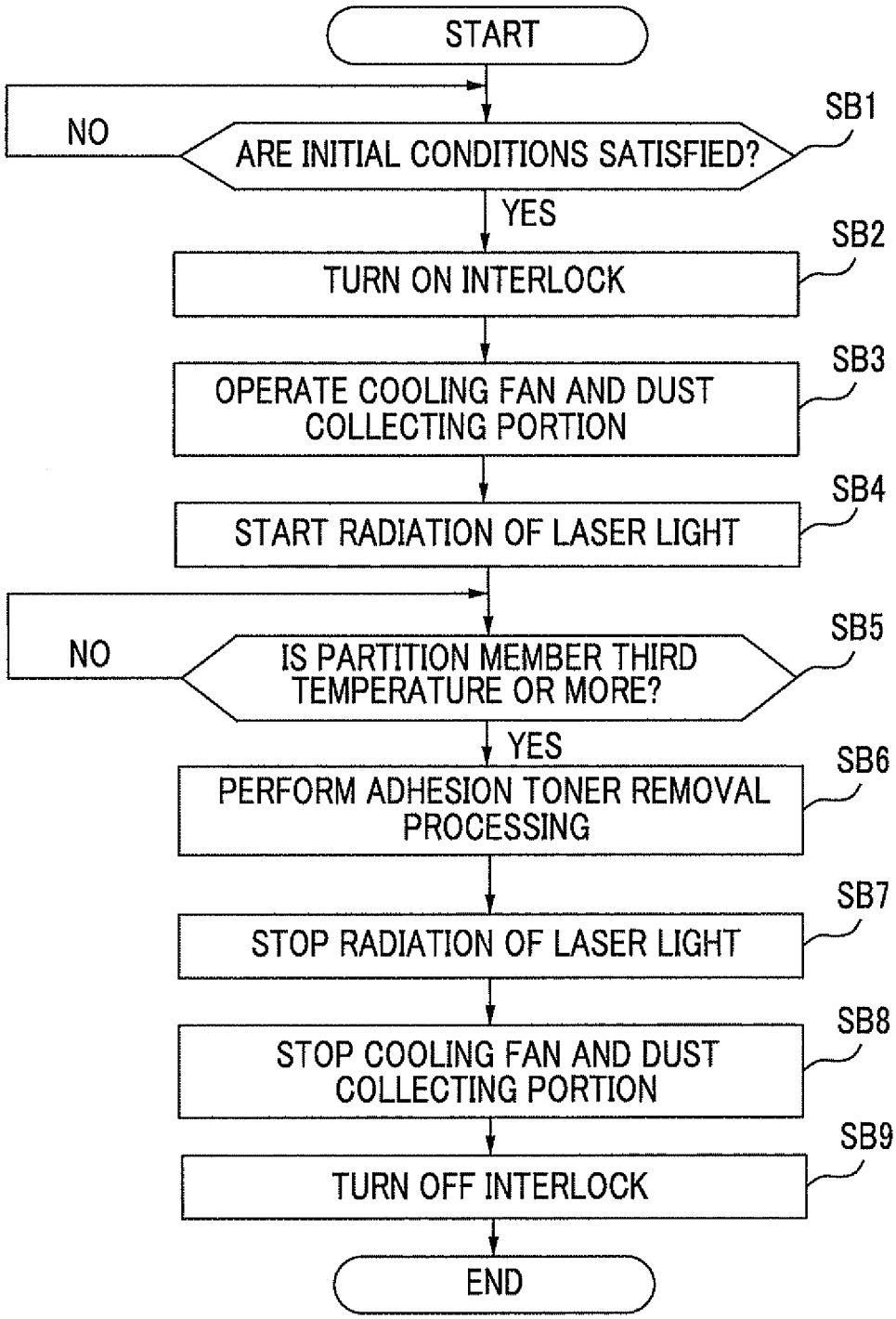
FIG. 7 is a flowchart showing an operation of the fixing device in a first modification.

FIG. 7 is a flowchart showing an operation of the fixing device 10 in a first modification. Hereinafter, portions different from the processing shown in FIG. 5 will be mainly described. In step SB4, the controller 1 starts the radiation of the laser light from the light source 111A. In step SB5, the controller 1 determines whether or not the temperature of the partition member 114 is equal to or higher than a third temperature. The third temperature is a temperature that is predetermined, and when the temperature of the partition member 114 is the third temperature, the adhesion toner is melted. Compared to before the radiation of the laser light LB starts and when the temperature of the partition member 114 is equal to or lower than the third temperature, when the temperature of the partition member 114 is the third temperature, the adhesion toner is more easily removed from the partition member 114. For example, the third temperature is 180° C. The controller 1 obtains the temperature of the partition member 114 from the temperature detection portion 15. In addition, in this example, since the third temperature is lower than the example of the first temperature (300° C.) described in the exemplary embodiment, in the step SB4, the controller 1 controls the light source 111A so that the irradiated laser light LB is output lower than the step SA4 of the exemplary embodiment. When the temperature of the partition member 114 is equal to or higher than the third temperature (YES at the step SB5), the controller 1 advances the processing to step SB6. When the temperature of the partition member 114 is lower than the third temperature (NO at the step SB5), the controller 1 continues the radiation of the laser light.

In step SB6, the controller 1 starts the adhesion toner removal processing using the cleaning portion 13. In the adhesion toner removal processing according to the first modification, the slide mechanism portion 132 reciprocates during a determined time. For example, the determined time is 2 minutes. The controller 1 continues the radiation of the laser light LB from the light source 111A while the adhesion toner removal processing is performed. Specifically, the controller 1 adjusts the output of the laser light LB so that the temperature of the partition member 114 is equal to or higher than the third temperature. If the adhesion toner removal processing ends, in step SB7, the controller 1 stops the radiation of the laser light LB from the light source 111A.

Figure 8:
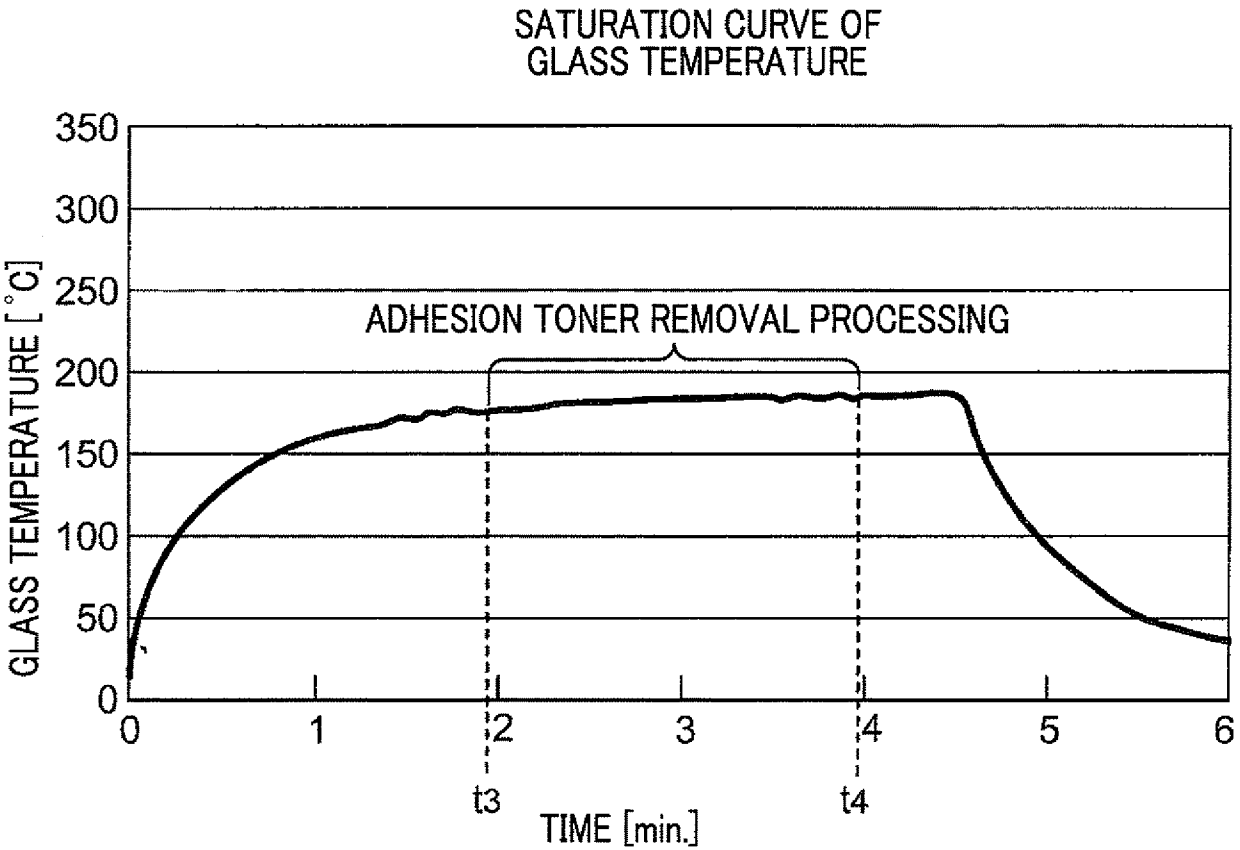
FIG. 8 is a graph showing temperature changes with the passage of time of the partition member in the first modification.

FIG. 8 is a diagram showing temperature changes with the passage of time of the partition member 114 in the first modification. In FIG. 7, in the step SB4, the time when the radiation of the laser light starts is expressed as 0 seconds. If the temperature of the partition member 114 is 180° C. at the time t3, the controller 1 adjusts the radiation of the laser light LB from the light source 111A and makes the partition member 114 to be maintained equal to or higher than 180° C. The slide mechanism portion 132 moves so as to reciprocate plural number of times in the direction shown by the arrow E in FIG. 3 during 2 minutes from the time t3 to a time t4. If the laser light LB is radiated during the adhesion toner removal processing, the scraping member 131*a* receives the laser light LB and is heated. Compared to the scraping member 131*a* that is not heated, the heated scraping member 131*a* more easily removes the adhesion toner.

Second Modification

In the above-described exemplary embodiment, the timing when the controller 1 starts the adhesion toner removal processing using the cleaning portion 13 is not limited to when the temperature of the partition member 114 is equal to or lower than the second temperature. The controller 1 may start the adhesion toner removal processing when a determined time ta (an example of the first time) elapses after the radiation of the laser light LB stops in the step SA6. The determined time ta is a time needed until the temperature of the partition member 114 that is the first temperature becomes a temperature at which the adhesion toner is more easily removed than the first temperature. For example, the determined time ta is a time needed until the temperature of the partition member 114 is decreased from the first temperature to equal to or lower than the second temperature. The determined time ta is stored in the ROM. In this case, in the step SA7, the controller 1 determines whether or not the determined time ta elapses.

In the first modification, the timing when the controller 1 starts the adhesion toner removal processing using the cleaning portion 13 is not limited to when the temperature of the partition member 114 is equal to or higher than the third temperature. The controller 1 may start the adhesion toner removal processing when a determined time tb (an example of the second time) elapses after the radiation of the laser light LB starts in the step SB4. The determined time tb is a time needed until the temperature of the partition member 114 before the radiation of the laser light LB starts becomes a temperature at which the adhesion toner is more easily removed than the temperature before the radiation of the laser light LB. For example, the determined time tb is a time needed until the temperature of the partition member 114 before the radiation of the laser light LB starts is increased to equal to or higher than the third temperature. The determined time tb is stored in the ROM. In this case, in the step SB5, the controller 1 determines whether or not the determined time tb elapses.

Third Modification

The light source 111A that radiates the laser light LB to the partition member 114 may not necessarily be all light sources 111A. For example, when the adhesion toner locally adheres to the partition member 114, the light sources 111A that radiates the laser light LB may be selected according to the area to which the adhesion toner adheres. That is, the light sources 111A that radiates the area to which the adhesion toner adheres in the partition member 114 radiates the laser light LB, and the other light sources 111A may not radiate the laser light LB. In this case, the user performing the cleaning of the adhesion toner opens the external cover, examines the area to which the adhesion toner adheres in the partition member 114, and may select the light sources 111A that radiate the laser light LB. Moreover, the area to which the adhesion toner adheres may be detected by a photosensor.

Fourth Modification

The direction in which the scraping member 131*a* moves so as to contact the partition member 114 is not limited to the transporting direction. The scraping member 131*a* may move in the width direction and remove the adhesion toner. In this case, the cleaning portion 13 is configured so that the slide mechanism portion 132 moves in the width direction.

Fifth Modification

The specific values representing the temperature, the time, the speed, and the like in the above-described exemplary embodiment and modifications only are an example, and the present invention is not limited thereto. For example, when the temperature at which the toner is melted is different according to the kind of toner, the first to third temperatures may be different from those of the exemplary embodiment. In addition, the number of times the scraping member 131*a* moves so as to reciprocate is also not limited to that described in the exemplary embodiment.

Other Modifications

The shape of the scraping member 131*a* is not limited to a plate shape. For example, the scraping member 131*a* may be a brush made of metal. In addition, the shape of the holding member 131*b* is also not limited to that described in the exemplary embodiment. The holding member 131*b* may have any shape provided as a member that holds the scraping member 131*a*.

The drive section is not limited to the slide mechanism portion 132 and the drive portion 133. The drive section may have any configuration provided as a configuration in which the scraping member 131*a* moves so as to contact the surface of the partition member 114 of the transport path r side.

In the exemplary embodiment, the example where the image forming apparatus 100 is a copying machine is shown. However, the image forming apparatus may be an apparatus which receives data of a bitmap format or a vector format from the outside via a communication IF6 and in which an image is formed based on the data.

In the exemplary embodiment, the example where the recording medium P is the continuous paper is shown. However, the recording medium P may be a recording medium that is cut for each page according to the determined size.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a radiating portion that radiates light on a recording medium on which a toner image is formed and that is transported along a transport path;

a partition member that transmits the light radiated from the radiating portion and partitions between the radiating portion and the transport path; and a drive section that moves a scraping member which scrapes toner that adheres to the partition member, the toner being heated by the radiation of the light from the radiating portion, wherein the scraping member contacts a transport path side surface of the partition member, the transport path side surface being a surface that faces the transport path, wherein the radiating portion radiates the light so that the temperature of the partition member is equal to or higher than a third temperature, and wherein the drive section moves the scraping member so as to scrape the toner when the temperature of the partition member is equal to or higher than the third temperature.

2. The fixing device according to claim 1, wherein the drive section moves the scraping member so as to start the scraping of the toner when a first time elapses after the radiating portion stops the radiation of the light.

3. The fixing device according to claim 2, further comprising:

a temperature detection portion that detects the temperature of the partition member, wherein the radiation of the light from the radiation portion is controlled based on the temperature that is detected by the temperature detection portion.

4. The fixing device according to claim 1, wherein the drive section moves the scraping member so as to start the scraping of the toner when a second time elapses after the radiating portion starts the radiation of the light.

5. The fixing device according to claim 4, further comprising:

a temperature detection portion that detects the temperature of the partition member, wherein the radiation of the light from the radiation portion is controlled based on the temperature that is detected by the temperature detection portion.

6. The fixing device according to claim 1, further comprising:

a temperature detection portion that detects the temperature of the partition member, wherein the radiation of the light from the radiation portion is controlled based on the temperature that is detected by the temperature detection portion.

7. An image forming apparatus comprising:

a formation portion that forms a toner image on a recording medium;

a transport portion that transports the recording medium on which the toner image is formed using the formation portion along a transport path; and the fixing device according to claim 1 that radiates light on the recording medium that is transported by the transport portion.

8. A fixing device comprising:

a radiating portion that radiates light on a recording medium on which a toner image is formed and that is transported along a transport path;

a partition member that transmits the light radiated from the radiating portion and partitions between the radiating portion and the transport path; and a drive section that moves a scraping member which scrapes toner that adheres to the partition member, the toner being heated by the radiation of the light from the radiating portion, wherein the scraping member contacts a transport path side surface of the partition member, the transport path side surface being a surface that faces the transport path, wherein the radiating portion stops the radiation of the light when a temperature of the partition member is equal to or higher than a first temperature, wherein the drive section moves the scraping member so as to scrape the toner after the radiating portion stops the radiation of the light, and wherein the drive section moves the scraping member so as to start the scraping of the toner when the temperature of the partition member is equal to or lower than a second temperature that is lower than the first temperature.

9. The fixing device according to claim 8, further comprising:

a temperature detection portion that detects the temperature of the partition member, wherein the radiation of the light from the radiation portion is controlled based on the temperature that is detected by the temperature detection portion.

10. An image forming apparatus comprising:

a formation portion that forms a toner image on a recording medium;

a transport portion that transports the recording medium on which the toner image is formed using the formation portion along a transport path; and the fixing device according to claim 8 that radiates light on the recording medium that is transported by the transport portion.

11. A fixing device comprising:

a radiating portion that radiates light on a recording medium on which a toner image is formed and that is transported along a transport path;

a partition member that transmits the light radiated from the radiating portion and partitions between the radiating portion and the transport path; and a drive section that moves a scraping member which scrapes toner that adheres to the partition member, the toner being heated by the radiation of the light from the radiating portion, wherein the scraping member contacts a transport path side surface of the partition member, the transport path side surface being a surface that faces the transport path, wherein the radiating portion stops the radiation of the light when a temperature of the partition member is equal to or higher than a first temperature, wherein the drive section moves the scraping member so as to scrape the toner after the radiating portion stops the radiation of the light, and wherein the drive section moves the scraping member so as to start the scraping of the toner when a first time elapses after the radiating portion stops the radiation of the light.

12. The fixing device according to claim 11, further comprising:

a temperature detection portion that detects the temperature of the partition member, wherein the radiation of the light from the radiation portion is controlled based on the temperature that is detected by the temperature detection portion.

13. An image forming apparatus comprising:

a formation portion that forms a toner image on a recording medium;

a transport portion that transports the recording medium on which the toner image is formed using the formation portion along a transport path; and the fixing device according to claim 11 that radiates light on the recording medium that is transported by the transport portion.

* * * * *